US008201622B2

(12) United States Patent
Reid et al.

(10) Patent No.: US 8,201,622 B2
(45) Date of Patent: Jun. 19, 2012

(54) PROTECTION SLEEVE

(75) Inventors: Michael A. Reid, Aberdeen (GB); Irvine C. Brown, Aberdeen (GB)

(73) Assignee: Red Spider Technology Limited, Westhill, Aberdeen (GB)

( * ) Notice: Subject to any disclaimer, the term of this patent is extended or adjusted under 35 U.S.C. 154(b) by 638 days.

(21) Appl. No.: 11/887,505

(22) PCT Filed: Apr. 3, 2006

(86) PCT No.: PCT/GB2006/001233

§ 371 (c)(1),
(2), (4) Date: Jul. 20, 2009

(87) PCT Pub. No.: WO2006/103477

PCT Pub. Date: Oct. 5, 2006

(65) Prior Publication Data

US 2009/0314492 A1 Dec. 24, 2009

(30) Foreign Application Priority Data

Apr. 1, 2005 (GB) ..... 0506640.2

(51) Int. Cl.
*E21B 17/10* (2006.01)
*E21B 17/12* (2006.01)

(52) U.S. Cl. ..... 166/85.3; 166/85.5; 166/208; 166/380; 166/381

(58) Field of Classification Search ..... 166/85.3, 166/85.5, 208, 380, 381
See application file for complete search history.

(56) References Cited

U.S. PATENT DOCUMENTS

| | | | | |
|---|---|---|---|---|
| 3,247,914 | A | 4/1966 | Slack | |
| 6,719,044 | B2 | 4/2004 | Ford et al. | |
| 6,749,018 | B1 | 6/2004 | Ford et al. | |
| 2001/0040054 | A1 * | 11/2001 | Haugen et al. | 175/61 |
| 2002/0092656 | A1 | 7/2002 | Ford et al. | |
| 2004/0200614 | A1 | 10/2004 | Stjernstrom et al. | |
| 2006/0016604 | A1 * | 1/2006 | Ford | 166/348 |

FOREIGN PATENT DOCUMENTS

| | | | |
|---|---|---|---|
| EP | 0 294 264 | A | 12/1988 |
| EP | 0 391 541 | A | 10/1990 |

OTHER PUBLICATIONS

Nipple Protection Sleeve, C/W Location Tool; Well-Equip Limited (Flow Control Equipment Catalogue), copyright Feb. 1995; pp. 20 and 21.
International Search Report dated Jul. 27, 2006.
International Preliminary Report on Patentability dated Oct. 3, 2007.

* cited by examiner

*Primary Examiner* — Giovanna Wright
(74) *Attorney, Agent, or Firm* — Ladas & Parry LLP

(57) ABSTRACT

A protection sleeve (12) for locking over a seal (72) in a wellbore is described. The sleeve (12) is adapted for releasable engagement to a running tool (14) and has a locking mechanism (28) comprising first and second tubula members and a collet (56) is provided. One tubular member includes a profile adapted to mate with a profile of the seal (72). The sleeve (12) may be located on a work string (14), including a rotary drill string, and the invention also relates to methods of running in, setting, carrying out an intervention operation and retrieving the sleeve in a single run. The invention has particular application in Through Tubing-Rotary Drilling (TTRD).

14 Claims, 5 Drawing Sheets

PROTECTION SLEEVE

CROSS REFERENCE TO RELATED APPLICATIONS

This application is the U.S. national phase, pursuant to 35 U.S.C. §371, of International Application No. PCT/GB2006/001233, published in English on Oct. 5, 2006 as International Publication No. WO 2006/103477 A1, which claims the benefit of British Application Ser. No. GB 0506640.2, filed Apr. 1, 2005. The content of each of the above-mentioned applications are incorporated by reference herein.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

1. Field of the Invention

The present invention relates to well tools and more particularly relates to a protection sleeve used to straddle seal bores such as those in tubing hangers, downhole safety valves and nipples, prior to well intervention operations.

2. Description of Related Art

In oil and gas well production, once a well is completed it may be necessary to re-enter the well to service or adjust equipment and optimise the performance of the well. Such re-entry is termed well intervention. During intervention it is necessary to run protection sleeves which cover seal bores within the existing well completion. These seal bores would typically be part of a tubing hanger, downhole safety valve or nipple. Without protection such seals may be damaged as further equipment is run through the completion. Once located in position, the sleeves allow access into the wellbore during the intervention and are then removed for production of the well to recommence.

Current protection sleeves are wireline conveyed or work string conveyed. Both these typically require a dedicated run to set the sleeve and a dedicated run to remove the sleeve. Once the sleeve is in position, the intervention is carried out via a wireline, coiled tubing or drill string. These provide the necessary clearance between the inner surface of the sleeve and the intervention work string.

Recently, new drilling techniques have placed a higher requirement on these protection sleeves. Due to the maturity of North Sea fields, the number of slots available to drill new wells is limited by the aging infrastructure. To address this, the industry has developed new drilling techniques to use the existing wellhead slots. This technique is termed Through Tubing Rotary Drilling (TTRD). The technique involves drilling a new section of the well through the existing well without having to pull the completion first. The point at which the new section of well is to be started is termed the kick off point. A whipstock packer is set at the predetermined location within the well and this is used to divert the drill string in the new direction. Conventional drillpipe, of smaller outer diameter ("OD"), is then run into the well through the existing tubing string until the whipstock is reached. At this stage the milling operation will commence, drilling a window through the existing tubing and casing to create a 'sidetrack' where the new well section is drilled.

As with previous intervention jobs a protection sleeve has to be run to prevent damage to the seal bores within the existing well completion. In the TTRD wells, the protection sleeve now has to protect against rotating drillpipe where non-rotating wireline or coiled tubing was previously used. Further as the milling operation takes place large amounts of debris and metal cuttings will need to be circulated past the sleeve.

SUMMARY OF THE INVENTION

It is an object of the present invention to provide a protection sleeve and protection sleeve assembly, with a method for running, setting and retrieving a protection sleeve in a wellbore on a work string.

It is an object of at least one embodiment of the present invention to provide a protection sleeve that may be coupled to a drill string to mitigate the need for a dedicated run to set the protection sleeve.

It is a further object of at least one embodiment of the present invention to provide a protection sleeve including a lock mechanism, the lock mechanism preventing the sleeve being pulled out of position as the drill pipe is operated. A further object of the invention is to provide a protection sleeve and/or locking mechanism with improved debris tolerance.

It is a still further object of the present invention to provide a method of running and setting a protection sleeve while creating a sidetrack in a wellbore.

According to a first aspect of the present invention there is provided a method of setting and unsetting a protection sleeve on a work string comprising the steps:

(a) mounting a protection sleeve on a running tool, the running tool being located in a work string;
(b) running the work string in a wellbore until a profile of the sleeve abuts a profile of a seal bore;
(c) locking the protection sleeve to the seal bore;
(d) releasing the running tool;
(e) running the work string with the running tool through the protection sleeve into the wellbore to perform an operation in the wellbore beyond the seal bore;
(f) pulling the work string from the wellbore so that the running tool engages the protection sleeve;
(g) releasing the protection sleeve from the seal bore; and
(h) retrieving the protection sleeve on the running tool as the work string is pulled from the well.

In this way, separate trips are not required into the wellbore to locate and retrieve the protection sleeve during intervention.

Preferably the method includes the step of applying an over pull to the sleeve to verify it is properly set.

Preferably the work string comprises a series of tubing sections rotatable in the wellbore. In this way, the work string may be a rotating drill pipe so that the invention is not limited to wireline and coiled tubing intervention.

Preferably the step of releasing the sleeve from the seal bore includes the step of over pulling the protection sleeve via the running tool. Preferably also this step includes trapping the lock in an unset position so that the lock cannot reset and become jammed in the well.

Preferably the method may include the additional step of noting that the lock has jammed and applying a high over pull to release the sleeve.

Preferably the method includes the further steps of resetting the lock and repeating steps.

According to a second aspect of the present invention there is provided a protection sleeve for locking over a seal in a wellbore, the sleeve comprising a substantially tubular body having a bore therethrough adapted for the clear passage of a work string, the body including a first sleeve member adapted for releasable engagement to a running tool and a locking mechanism, the locking mechanism comprising first and second tubular members, engaging means to releasably engage the tubular members to each other, and a collet having a plurality of fingers retained within the body in a first position; held in an expanded configuration, proud of the body, in a second position; and released back within the body in a third position, wherein the second tubular member includes a profile adapted to mate with a profile of the seal and in the second position, the fingers locate within the profile of the seal.

In this way, the fingers lock the sleeve to the seal bore so that its passage is prevented in either direction. An over pull on the work string can be used to ensure the lock is set i.e. that the fingers are located within the seal profile. Release of the running tool then allows the work string to pass through the sleeve. Additionally by releasing the fingers back within the sleeve body, the sleeve can be removed when the work string is removed from the wellbore.

Preferably the first sleeve member includes a shoulder adapted for engagement to a surface of a running tool. The running tool can then be used to pick up the protection sleeve when the work string, including the running tool, is pulled from the wellbore.

Preferably the engaging means is a shearable means. The shearable means may be by pins, shear ring, or the like. Most preferably the engaging means is a shear ring.

Preferably the sleeve further comprises one or more windows, the windows providing a fluid flow passage between the outside of the sleeve and the bore. More preferably the windows are located at the collet. In this way debris is prevented from building up within the collet and preventing the fingers from moving to the third position to unset the lock.

Preferably the locking mechanism further comprises a trap to prevent the lock moving from the first or third positions. Preferably the trap comprises a c-ring locatable in a recess. This prevents the lock from setting as a result of movement of the mechanism, for instance, when the being used on a floating oil rig.

According to a third aspect of the present invention there is provided a protection sleeve assembly adapted for connection in a work string, the assembly comprising a protection sleeve according to the second aspect and a running tool, the running tool including connection means for locating in a work string, engaging means for releasably attaching the protection sleeve during run in and a shoulder to pick up the protection sleeve when the work string is removed from the wellbore.

Preferably the engaging means is a shearable means. The shearable means may be by pins, shear ring, or the like. Most preferably the engaging means is a shear ring.

Preferably the shear ring is rated to release after the lock has been set, that is when the sleeve is in the second position.

Preferably the running tool includes a plurality of upsets on an outer surface. These upsets ensure the sleeve is properly centralised when both running in the well and being pulled from the well.

According to a fourth aspect of the present invention there is provided a method of creating a sidetrack in a completed wellbore;

(a) mounting a protection sleeve on a running tool, the running tool being located in a drill string;
(b) running the drill string in a wellbore until a shoulder of the sleeve abuts a shoulder of a seal bore;
(c) locking the protection sleeve to the seal bore;
(d) releasing the running tool;
(e) running the drill string with the running tool through the protection sleeve into the wellbore to a whipstock in the wellbore;
(f) drilling a window to create a sidetrack;
(g) drilling the sidetrack wellbore;
(h) pulling the drill string from the wellbore so that the running tool engages the protection sleeve;
(i) releasing the protection sleeve from the seal bore; and
(j) retrieving the protection sleeve on the running tool as the drill string is pulled from the well.

Preferably also the running tool is located near the drill bit. More preferably the distance between the drill bit and the running tool is less than the distance between the seal bore and the whipstock. In this way the running tool is designed to pass through the milled window.

Preferably the method includes the step of applying an over pull to the sleeve to verify it is properly set.

Preferably the step of drilling is achieved by rotation of at least a portion of the drill string on the wellbore.

Preferably the step of releasing the sleeve from the seal bore includes the step of over pulling the protection sleeve via the running tool. Preferably also this step includes trapping the lock in an unset position so that the lock cannot reset and become jammed in the well.

Preferably the method may include the additional step of noting that the lock has jammed and applying a high over pull to release the sleeve.

Preferably the method includes the further steps of resetting the lock and repeating the steps.

According to a fifth aspect of the invention there is provided a method of carrying out a downhole operation, the method comprising the steps of:

(a) forming an assembly from a protection sleeve and a running tool, the running tool adapted to be part of a work string;
(b) running a work string including the assembly in a wellbore until a profile of the assembly abuts a profile of a seal bore;
(c) releasably engaging the protection sleeve with the seal bore;
(d) releasing the running tool from the protection sleeve;
(e) running the work string with the running tool through the protection sleeve into the wellbore to perform an operation in the wellbore beyond the seal bore.

According to a sixth aspect of the invention there is provided a method of carrying out a downhole operation, the method comprising the steps of:

(a) Performing an operation using a workstring at a wellbore location below a seal bore;
(b) pulling the work string from the wellbore so that a running tool on the workstring engages a protection sleeve at the seal bore;
(c) releasing the protection sleeve from the seal bore; and
(d) retrieving the protection sleeve on the running tool as the work string is pulled from the well.

The fifth and sixth aspects of the invention may be combined with optional and preferred features of the embodiments of any of the first to fourth aspects of the invention defined above.

An embodiment of the present invention will now be described, by way of example only, with reference to the following Figures of which:

DETAILED DESCRIPTION OF PREFERRED EMBODIMENTS

Figure 1A:
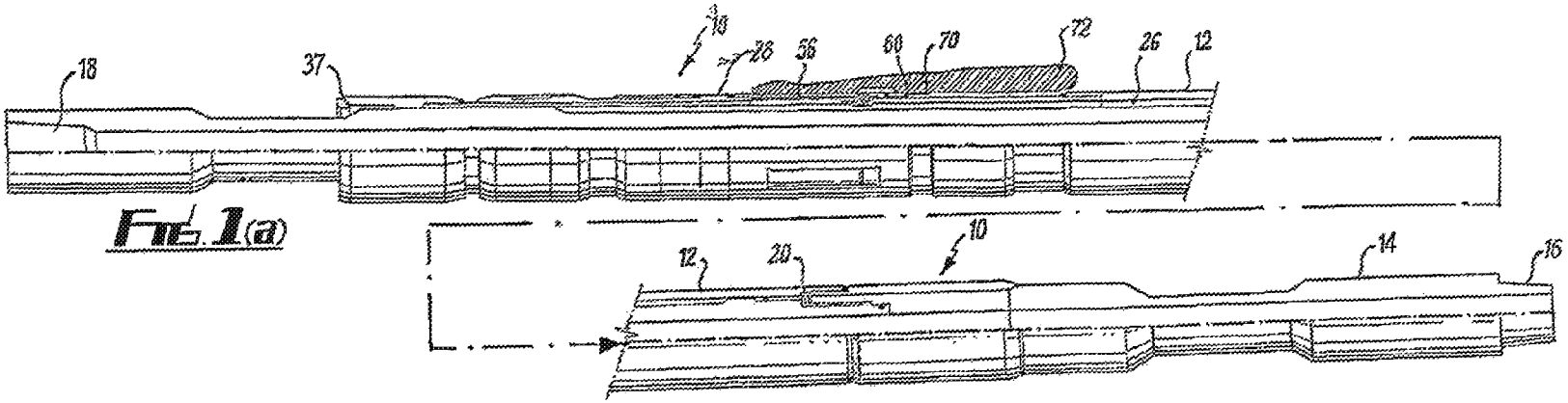
FIGS. 1(*a*), (*b*) and (*c*) are part cross-sectional views through a work string including a protection sleeve and running tool, where the sleeve is in the (a) first, (b) second and (c) third positions.
Figure 1B:
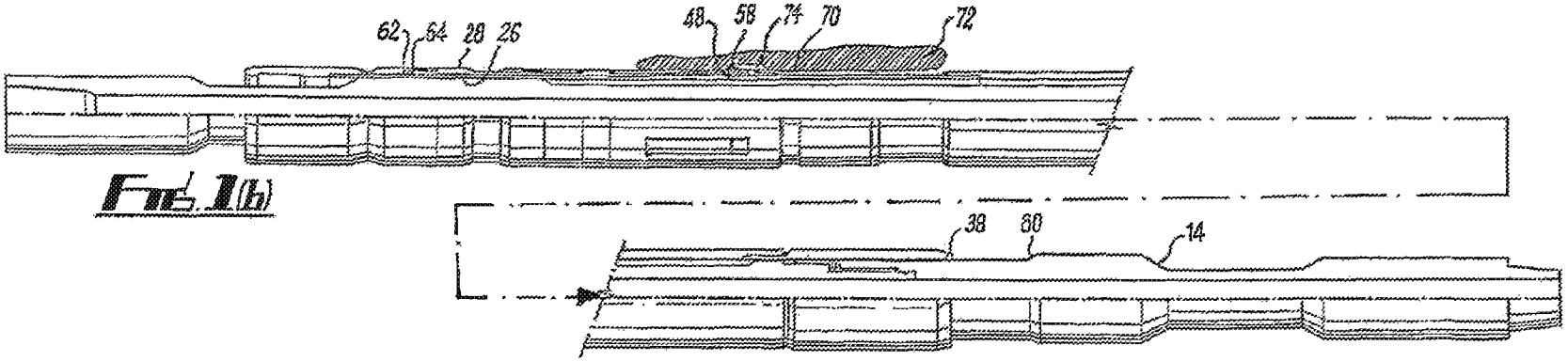
Figure 1C:
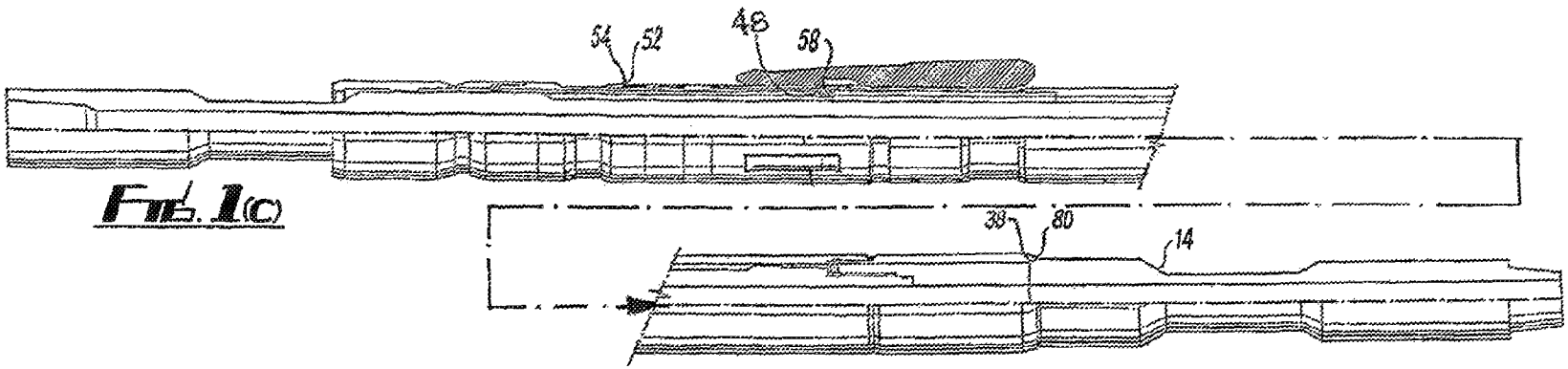

Reference is initially made to FIG. 1 of the drawings which illustrates a protection sleeve assembly, generally indicated by reference numeral 10, in accordance with an embodiment of the present invention. Assembly 10 comprises a protection sleeve 12 and a running tool 14. The running tool 14 is connected in a work string (not shown) via pin section 16 and box section 18. The running tool 14 is releasably connected to the sleeve 12 by a shear ring 20.

Figures 2A, 2B, 2C:
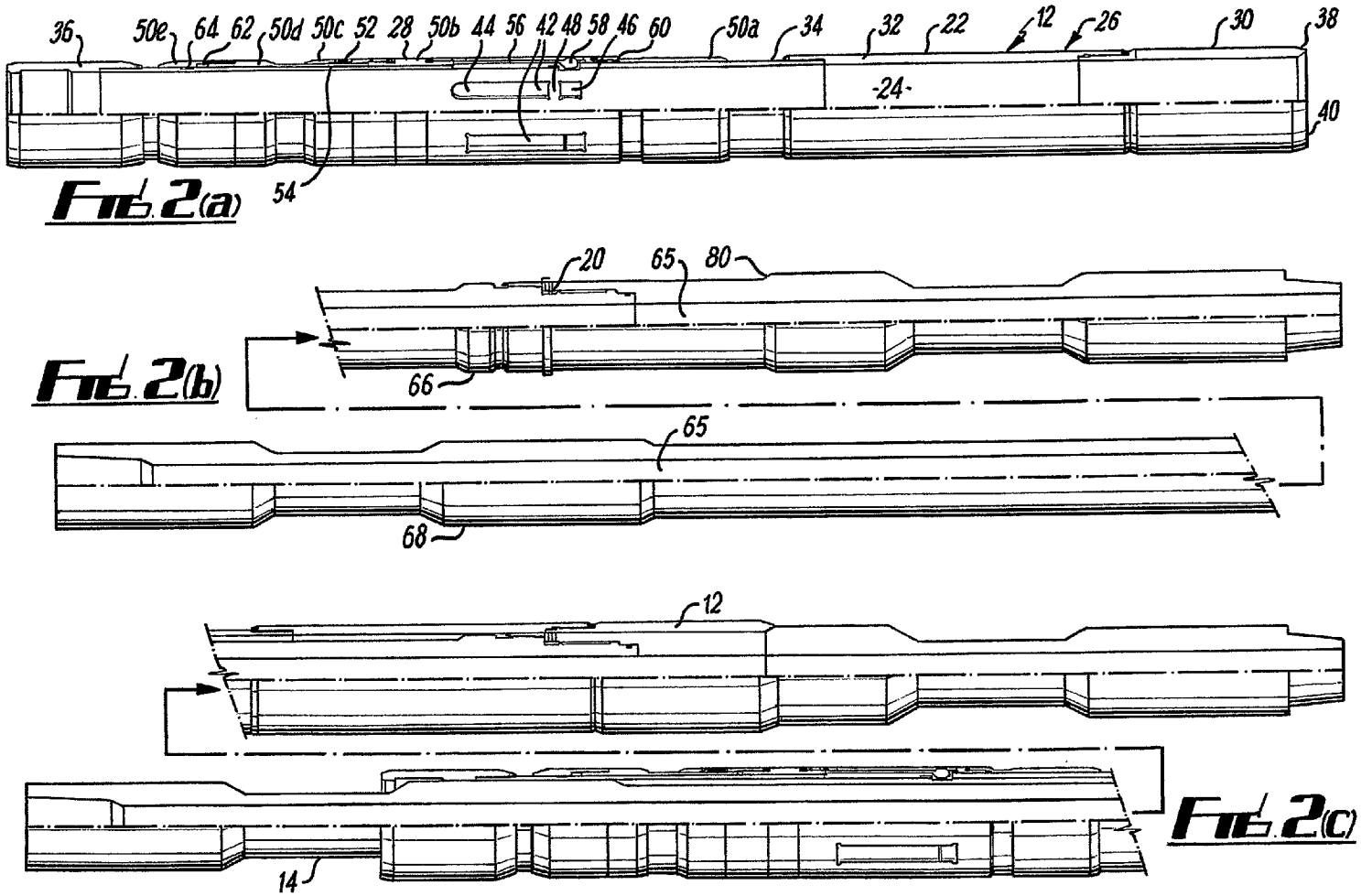
FIGS. 2(*a*), (*b*) and (*c*) are part cross-sectional views through the (a) sleeve, (b) the running tool and (c) the protection sleeve assembly of FIG. 1.

Reference is now made to FIG. 2 of the drawings which illustrates the parts 12, 14 in greater detail. FIG. 2(*a*) illustrates the protection sleeve 12. Sleeve 12 comprises a tubular body 22 having a bore 24 therethrough. Body 22 is relatively thin-walled to provide a large cross-sectional area for the bore so that work strings can pass through the bore 24 without hindrance. Body 22 is made up of a sleeve assembly 26 and a locking mechanism 28. Sleeve assembly 26 comprises a bottom sub 30, a straight section 32, a milled section 34 and a top sub 36. The subs 30, 36 and sections 32, 34 are all annular and joined by threaded connections. Of note is that the bottom sub 30 is left hand threaded at the connection. This is done to prevent the bottom sub 30 from unscrewing when rotating drill pipe passes through the sleeve 12. The bottom sub 30 also includes a circumferentially arranged shoulder 38 at its base 40. This is designed so that the sleeve 12 can be picked up easily by the running tool 14.

Milled section 34 includes five windows 42*a-e* arranged circumferentially around the section 34, co-linearly with the axis of the bore 24. Each window has a first elongate opening 44 and a smaller square opening 46. The opening 44, 46 are separated by a tab 48. Tab 48 is a portion of the sleeve section 34, typically of metal, which is shearable under high loading. The purpose of the windows 44 and the tabs 48 will be described hereinafter with reference to the locking mechanism 28.

Figures 3A, 3B, 3C:
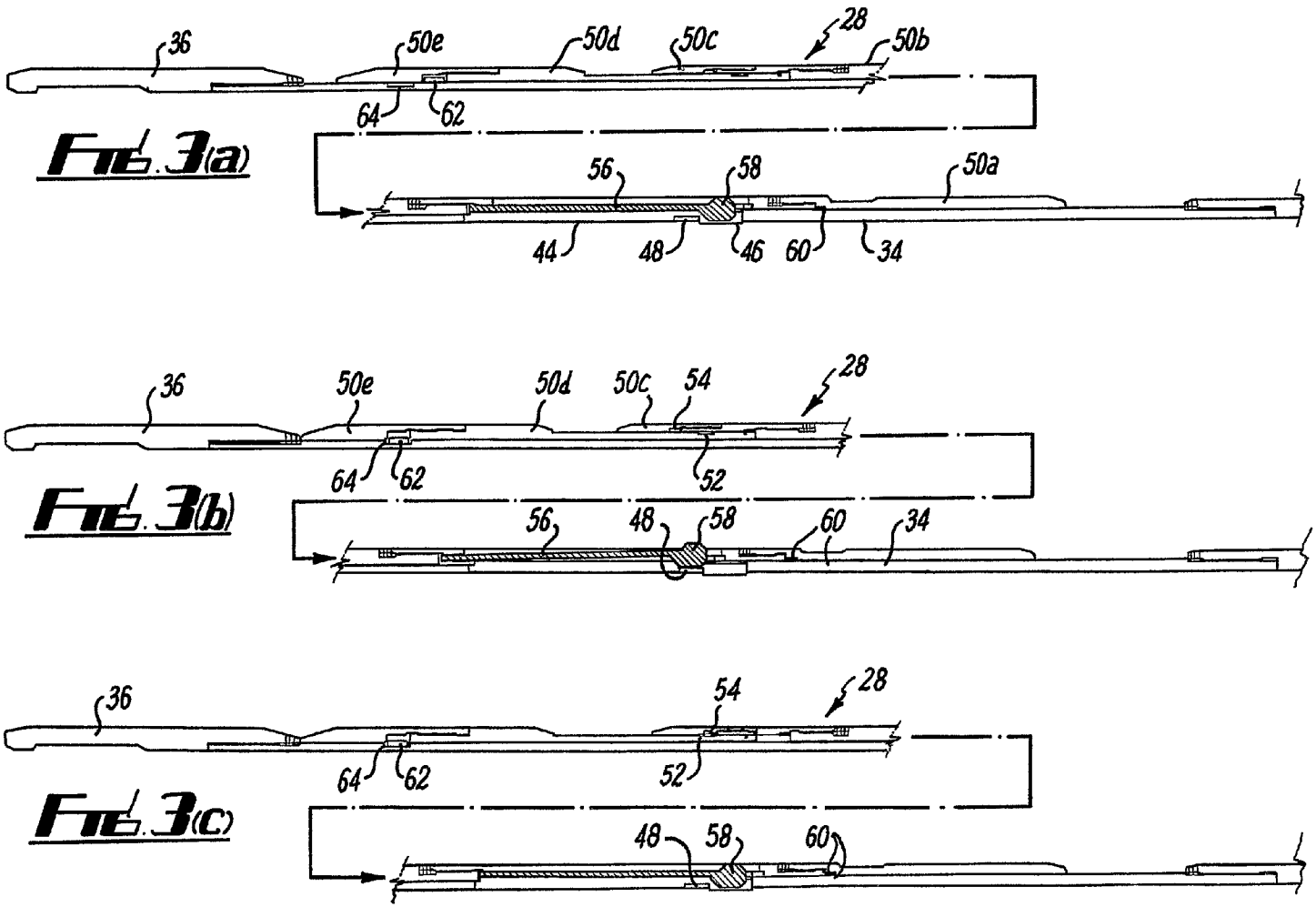
FIGS. 3(*a*), (*b*) and (*c*) are schematic illustrations of the locking mechanism in the (a) first, (b) second and (c) third positions, of the protection sleeve of FIG. 1.

Locking mechanism 28 consists of five tubular members 50*a-e*. The members 50*a-e* are all fixed, typically by screw thread, to the adjacent member except for members 50*c* and 50*d*. These features are best seen with the aid of FIG. 3. Like parts have been given the same reference numeral throughout the Figures to aid clarity.

On the member 50*d* there is located a recess 52 into which a c-ring 54 can locate when they are arranged over each other. The ring 54 is initially held in the member 50*c*. The depth of the recess 52 is less than the height of the ring 54, so that when the ring 54 lands in the recess 52, the ring 54 abuts the member 50*c* and the members 50*c, d* will move together.

Protruding from member 50*b* are five collet fingers 56. The fingers 56 are arranged equidistantly around the body 22. Each finger naturally lies within the wall of the sleeve, being bounded by the milled section 34 and tubular member 50*a*. The fingers 56 may thus be considered as a reverse collet as they are not forcibly retained in their first position.

The locking mechanism 28 is initially held to the sleeve assembly 26 by virtue of a shear ring 60 located across the member 50*a* and the milled section 34, the ring 60 being shearable to release the member 50*a* and section 34 from each other under a predetermined force. Further a c-ring 62 which is located within the section 50*e* against the milled section 34, can be moved into a recess 64 on the milled section 34. Such movement is in a reverse direction to that used between the members 50*c, d* using ring 54 in recess 52. C-ring 62 is thus used to hold the locking mechanism 28 in a position, termed the second position, while c-ring 54 is used to hole the locking mechanism 28 in a further position, termed the third position.

It will be appreciated that the running tool 14 used with the present invention could encompass several variations. In this embodiment, the tool is of two-part construction so that the shear ring 20 can be easily inserted to hold the sleeve 12 to the tool 14 during initial installation or assembly. On an outer surface is an upward directed ledge 80 designed to abut the sleeve 12. The tool 14 has a bore 64 to provide a continuous path through the work string to which it is attached. The bore 64 is preferably of the same cross-sectional area or greater than the bore of the work string to which it is attached. The outer surface of the tool 14 is provided with upsets 66, 68 to ensure the sleeve 12 mounted thereon is properly centralised. Generous radii are provided on all upsets on the running tool 14 and the sleeve 12. This is to address the potential for hanging up on the well profile when running in and out of the well.

Referring back to FIGS. 1(*a*) to 1(*c*), in use, the bottom sub is located on the running tool 14 so that the shoulder 38 abuts the ledge 80. Shear ring 20 is located between the sub 30 and the tool 14. The remaining parts of the sleeve 12 are then located onto the running tool 14. These parts may be pre-connected or may be connected as they are located on the tool 14. The collet fingers 56 are arranged such that the head 58 of each finger 56 lies within the square window 46. Each tab 48 is arranged behind the finger 56 adjacent to the head 58. C-ring 54 is held within the member 50*c* and c-ring 62 is held within the member 50*e*. Shear ring 60 is located between the sleeve assembly 26 and the locking mechanism 28 holding these parts together. This configuration is referred to as the first position. The running tool 14 is connected in a work string and the whole assembly 10 is run into a completed well. This is as illustrated in FIG. 1(*a*).

On reaching a seal within the wellbore, an outer profile 70 on the catches a profile, such as a nipple profile 72, within the wellbore. The member 50*c* is held at the profile 72. As the work string continues to move into the well, force is applied between the member 50*c* and the sleeve assembly 26 such that the shear ring 60, therebetween, shears and the parts separate. Note that the sheared sections are held within the members 50*c* and section 34 so that they cannot become jammed any where in the assembly 10. These sheared parts may be retrieved later when the assembly 10 is brought to the surface.

When ring 60 shears, the locking mechanism 28 moves relative to the sleeve assembly 26. This causes the tabs 48 to be pushed under the collet heads 58 and thereby force the collet radially outwards. The collet heads 58 then locate within a recess 74 of the nipple profile 72. At the same time, c-ring 62 is pushed into the recess 64 so that the locking mechanism 28, via the member 50*e*, is locked to sleeve assembly 26. This locks the tabs 48 behind the collet heads 58 and effectively locks the sleeve 12 to the nipple profile 72. At this point an over pull on the work string will indicate that the sleeve 12 is locked in position against the nipple profile 72 and the seal bore is therefore protected. This is as illustrated in FIG. 1(*b*).

In this, the second position, the work string can be run through the sleeve 12. With the sleeve 12 locked in position against the nipple profile 72, a downward force from the work string will cause shear ring 20 to shear, so that the running tool 14 and work string can pass through the sleeve 12 to a greater depth within the wellbore. It will be appreciated that the string may contain further tools such that intervention work can be performed below the level of the nipple profile 72.

When the intervention work is complete, the work string is pulled from the wellbore. As the running tool 14 reaches the sleeve 12, the ledge 80 on the running tool 14 is brought up and contacts the shoulder 38 on the sleeve 12. There is no requirement for a special mating arrangement, this simple contact can be used to release the sleeve 12. When the contact is made, an over pull is applied to the work string. This overpull will move the member 50*d* relative to the member 50*c*. Movement of the member 50*d* moves the milled section 34 as the two are engaged via the c-ring 62. As the tabs 48 are on the milled section 34, these tabs 48 move from under the collet heads 58 and consequently the collet retracts back into the sleeve body 22. This effectively releases the lock and the sleeve 12 is unset. During the movement, c-ring 54 will be located over recess 52 and seat therein to join the members 50*c* and 50*d* together. This will halt the passage of the tabs 48 so that they rest behind the fingers 56 as for the first position. The lock mechanism 28 is thus trapped in the unset position and cannot move back to the locked position. This is especially applicable when the sleeve is used on a floating oil rig. Without this mechanism the up and down motion of the oil rig may cause the lock to reset and become jammed in the well.

Further pulling on the work string will now move the sleeve 12 with the running tool 14, so that the sleeve 12 is retrieved to the surface of the well. This is as illustrated in FIG. 1(*c*) and referred to as the third position.

Once on the surface, the sleeve 12 and running tool 14 can be reset by replacement of the shear rings 20, 60 and repositioning of the c-rings 54, 62. Advantageously milled windows in the outer housings covering the c-rings 54, 62 allow for easy resetting of the lock mechanism 28 for re-run in the well. Access can still be gained to the c-rings if they become jammed with debris and the lock cannot be reset.

A further feature of the protection sleeve 12 is that it is debris tolerant. The milled slots or windows 44 under each finger 56 gives nowhere for the debris to jam and prevent the lock mechanism from unsetting. Additionally, the tabs 48, which support each finger 56 in the set position, are calibrated to shear out at a predetermined value so that they form an emergency shear out facility for the locking mechanism 28. If the locking mechanism 28 jams for some reason then a high value over pull will shear out the tabs 48 and de-support the collet fingers 56 allowing the sleeve 12 to be pulled from the well.

A yet further feature of the protection sleeve 12 is that, if necessary, it can be retrieved for the well using a fishing tool as is known in the art. The fishing tool would latch into the fishing neck 37 provided on the top sub 36 and the sleeve 12 would then be pulled to the surface. Such a procedure is likely to be required in the event that the work string parts and the running tool are lost downhole.

Figure 4:
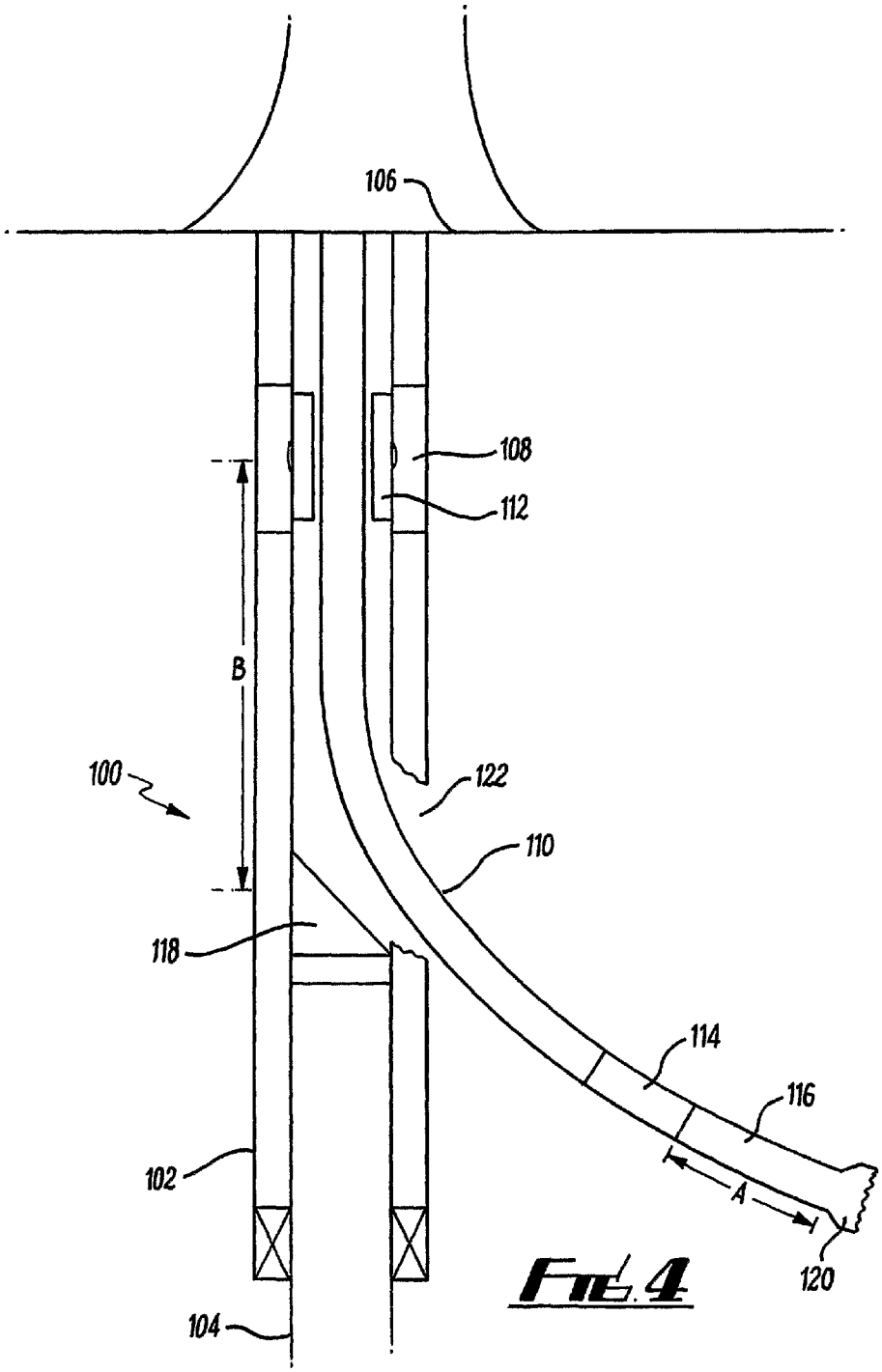
FIG. 4 is a schematic illustration of a wellbore in which a sidetrack is being drilled through a completion using the protection sleeve of the present invention.

The present invention is especially suitable for creating sidetracks in existing wellbore completions. This is as illustrated in FIG. 4. In an existing completed wellbore 100, there is typically located a cemented casing string 102 with a production tubing 104 arranged within. Near the surface 106 of the well 100 is a seal bore 108, which may be a safety valve. In order to provide a side track 110, a drill string needs to be inserted through the completion and sidetracked through the casing 102. This form of intervention requires a protection sleeve to be inserted over the seal bores 108 to prevent them from being damaged by the passage of the drill string and by the returned mud and cuttings during drilling. In the prior art an initial run would be required to locate a protection sleeve over the seal bore. Indeed an individual run would be needed for each seal bore in the completion. With the present invention the sleeve 112 or sleeves, as appropriate, are located on running tools 114 which form part of the drill string 116. Thus a single trip into the completed well can be made to both set the sleeves and drill the side track. With a whipstock packer 118 located in the wellbore, the drill string 116 is run into the completion. The running tool 114 is located near the drill bit 120, so that the sleeve 112 is set as early as possibly to reduce the potential damage on the seal bore 108. The/or each sleeve 112 is set and locked in position as described herein with reference to FIGS. 1 to 3. Once locked the drill string continues to run into the well, through the protection sleeve. The slimline design of the sleeve and in particular the lock mechanism allows a larger size of drill pipe to be run through it than a conventional lock design would. Additionally, an over pull can be applied to check that the sleeve 112 has been locked in position before continuing into the well.

The drill bit 120 is diverted via the whipstock 118 and mills a window 122 through the tubing 104 and casing 102. The running tool 114 is essentially part of the drill string 116. The running tool 114 is run into the remainder of the well and performs as per the drill pipe 116 and any bottom hole assembly 120. This is possible as the running tool 114 is of simple construction and has no moving parts. This allows the running tool 114 to enter through the milled window section 122 without risk of damage to the running tool 114 or milled window 122. More complicated running tools may not pass through this window 122 without risk of damage to the running tool or window. In that case the running tool would have to be spaced out properly on the drill string so it never reached the window once the side track had been entirely drilled. The down side to spacing the sleeve in this fashion is that long sections of the drill pipe have to pass through the seal bore before the protection sleeve can be locked in place which results in damage to the seal bore. Preferably also the running tool is located near the drill bit. Thus in this design the distance between the drill bit and the running tool, A, is less than the distance between the seal bore and the whipstock, B. In this way the running tool is designed to pass through the milled window.

Once the sidetrack is drilled, the drill pipe 116 is pulled from the well 100. When the running tool 114 reaches the sleeve 112, the sleeve 112 is unlocked and picked up on the tool 114 as described above. The sleeve 112 is then retrieved to the surface.

The principal advantage of the present invention is that it provides a protection sleeve and protection sleeve assembly, with a method for running, setting and retrieving a protection sleeve in a wellbore on a work string in a single trip.

A further advantage of the present invention is that it provides a protection sleeve which is locked in position against a seal bore. The lock is effected in both the set and unset positions which allows the assembly to be used on floating oil rigs where the up and down movement might otherwise cause a lock to reset. The lock can be checked by a simple over pull on the string.

A yet further advantage of the present invention is that it provides a protection sleeve assembly in which shear rings are used so that, once parts are separated the sheared portions remain within the assembly and cannot cause the string to jam in the wellbore.

Modifications may be made to the invention herein described without departing from the scope thereof. For example, multiple sleeves may be set from a single work string by correctly spacing out running tools on the string.

The invention claimed is:

1. A protective sleeve for locking over a seal in a wellbore, the sleeve comprising:

a substantially tubular body having a bore therethrough adapted for the clear passage of a work string, the body including a first sleeve member adapted for releasable engagement to a running tool and a locking mechanism, the locking mechanism comprising first and second tubular members, engaging means to releasably engage the tubular members to each other, and a collet having a plurality of fingers retained within the body in a first position; held in an expanded configuration, proud of the body, in a second position; and released back within the body in a third position, wherein the second tubular member includes a profile adapted to mate with a profile of the seal and in the second position, the fingers locate within the profile of the seal.

2. The protection sleeve as claimed in claim 1 adapted to lock the sleeve member to the seal bore so that movement is prevented in the downhole and uphole directions.

3. The protection sleeve as claimed in claim 1, wherein the first sleeve member includes a shoulder adapted for engagement to a surface of a running tool.

4. The protection sleeve as claimed in claim 1 wherein the engaging means is a shearable means.

5. The protection sleeve as claimed in claim 4 wherein the shearable means is a shear pin.

6. The protection sleeve as claimed in claim 4 wherein the shearable means is a shear ring.

7. The protection sleeve as claimed in claim 4 wherein the shearable means is rated to release after the locking mechanism is set in the second position.

8. The protection sleeve as claimed in claim 1 wherein the sleeve member further comprises one or more windows, the windows providing a fluid flow passage between the outside of the sleeve and the bore.

9. The protection sleeve as claimed in claim 8 wherein the windows are located at the collet.

10. The protection sleeve as claimed in claim 1 wherein the locking mechanism further comprises a trap to prevent the locking mechanism moving from the first or third positions.

11. The protection sleeve as claimed in claim 10 wherein the trap comprises a c-ring locatable in a recess.

12. A protection sleeve assembly adapted for connection in a work string, the assembly comprising a protection sleeve according to claim 1 and a running tool, the running tool including connection means for locating in a work string; engaging means for releasably attaching the protection sleeve during run in, and; a shoulder to pick up the protection sleeve when the work string is removed from the wellbore.

13. The protection sleeve assembly as claimed in claim 12 wherein the running tool includes a plurality of upsets on an outer surface.

14. The protection sleeve assembly as claimed in claim 12, wherein the protection sleeve is adapted to remain locked to the seal when an over pull beneath a predetermined threshold is applied to the work string.

* * * * *